United States Patent [19]

Rieger

[11] Patent Number: 4,699,695

[45] Date of Patent: Oct. 13, 1987

[54] NICKEL PLATING BATH

[76] Inventor: Franz Rieger, Riedstrasse 1 - 3, 7924 Steinheim am Albuch, Fed. Rep. of Germany

[21] Appl. No.: 818,985

[22] Filed: Jan. 10, 1986

Related U.S. Application Data

[63] Continuation of Ser. No. 632,945, Jul. 20, 1984, abandoned.

[51] Int. Cl.[4] ..... C25D 3/12

[52] U.S. Cl. ..... 204/33; 204/38.1; 204/44.7; 204/49

[58] Field of Search ..... 204/38.1, 33, 44.7

[56] References Cited

U.S. PATENT DOCUMENTS

| | | | |
|---|---|---|---|
| 2,473,163 | 6/1949 | McCoy | 204/33 |
| 2,694,019 | 11/1954 | Gutzeit | 427/438 |
| 2,774,688 | 12/1956 | Girard | 106/1.27 X |
| 3,284,323 | 11/1966 | Leloup | 204/38.1 |
| 3,531,379 | 9/1970 | Peach | 204/33 |
| 3,634,209 | 1/1972 | Wolf et al. | 204/40 |
| 3,726,771 | 4/1973 | Coll-Palagos | 204/33 X |

FOREIGN PATENT DOCUMENTS 2442300 3/1975 Fed. Rep. of Germany ..... 204/44.7

OTHER PUBLICATIONS

Chemical Abstracts, vol. 72, p. 424, 17797z, (1970).

R. S. Vakhidov et al., Elektrokhimiya, vol. 12, No. 6, pp. 989–991, Jun. 1976.

Rieger, Chemical Abstracts 101(1984), #160149 (Abstract of Germ. Offen. DE 3246323.

*Primary Examiner*—Arthur P. Demers

*Attorney, Agent, or Firm*—M. Robert Kestenbaum

[57] ABSTRACT

A nickel bath for electroplating aluminum and aluminum alloys with nickel is comprised of high proportions of nickel sulfate, small proportions of an acid which stabilizes the pH values, and very small proportions of a fluoride which loosens the oxide layer appearing in the Licer bath, of a chloride which promotes the dissolution of the nickel anodes and of a phosphite which improves the adhesive strength of the nickel layer.

The solids are kept in suspension in the bath by vigorous circulation, for example by means of air. The particle size should preferably be 3 micrometers.

9 Claims, No Drawings

NICKEL PLATING BATH

This is a continuation of patent application Ser. No. 632,945, filed July 20, 1984, of the same invention, now abandoned.

The invention relates to a nickel bath for electroplating aluminum and aluminum alloys with nickel.

BACKGROUND OF THE INVENTION

In the inventor's German Offenlegungsschrift No. 2,920,632, a process for the cathodic deposition of a nickel layer is described. On page 13, paragraph 3 a nickel bath is mentioned.

OBJECT AND STATEMENT OF THE INVENTION

It is the object of the invention to indicate a nickel bath which can be used in this process and leads to very considerable improvements.

According to the invention, this object is achieved by a nickel bath which comprises high proportions of nickel sulfate, small proportions of an acid which stabilizes the pH values, and very small proportions of a fluoride which loosens the oxide layer forming in the Licer bath, of a chloride promoting dissolution of the nickel anodes and of a phosphite improving the adhesive strength of the nickel layer. The Licer bath is a bath of an acquious solution of phosphoric acid immediately preceeding the nickel bath.

The invention leads to the following advantages:

1. Adhesion problems in the further coating with other metals are overcome.
2. The metal which follows in further coating is satisfactorily bonded to the nickel layer without intermediate activation.
3. A nickel layer which can readily be activated can be deposited from the electrolyte.
4. The bath is very suitable for coating cast, diecast, wrought and extruded aluminum or aluminum alloys.
5. The bath has a markedly faster covering power on pure aluminim or on low-alloy, heavy metal-free aluminum types, such as, for example, AlMg,Si 0.5.
6. In spite of a substantially higher nickel ion concentration, this can fluctuate within a wide range, without disadvantageous consequences for the deposition having to be feared.
7. Therefore, even under heavy loadings, the bath does not need to be checked analytically as frequently as the known baths.
8. The novel bath is ready to operated even at 50° C. and above, whereas known baths require temperatures of at least 65° C.
9. Formation of complexes in the bath is so slight that effluent treatment does not cause any difficulties. This is extremely important for preventing pollution.
10. Relatively thick layers of 20 micrometers and more can be deposited without any problems.
11. It is very important that carbides can also be incorporated in this layer, whereby the wear resistance is increased.
12. The bath is very stable, so that precipitation of nickel on the walls of the bath container is impossible. It is therefore not necessary to empty and clean the bath at short intervals.
13. A bath which may have been contaminated with organic products can very easily be regenerated again.
14. In particular when aluminum components of internal combustion engines are to be nickel-coated, the bath is outstandingly suitable. Especially with aluminum pistons, excellent results can be obtained. A known American process prescribes the coating of aluminum pistons with about 50 micrometers of iron and subsequent coating with tin at 1–3 micrometers. In contrast to this process, the iron layer can now be replaced by a nickel layer from this bath. Such pistons very readily pass engine tests, such as, for example, cold starting, scorching test, prolonged running test, 1000 hours under full load, and the like. After the nickel-coating and the subsequent tinning, the pistons are then also worked mechanically. When this is being done, no peeling or edge cracks appear. Further tinning of the piston takes place after the mechanical treatment of the piston. In this way, the exposed parts (base metal) can then be covered with a thin tin layer. The nickel carrier layer according to the invention withstands the partial aggressive chemical treatment without faults.
15. Die-cast aluminum hot plates can be coated with good adhesion, in spite of high heat stress.
16. The wear resistance of motorcycle components, for example dynamo covers, is increased by additional incorporation of silicon carbide.
17. When cooling plates for transistor ignition systems are coated by the bath according to the invention, soldering and adhesive bonding of these cooling plates becomes substantially easier.
18. Die-cast aluminum valve housing can now be precoated from the bath according to the invention, in order to reduce wear, and then chemically nickel-plated further. The inner cylinder walls can now be coated to about 5 micrometers. This gives a considerable increase of service life under frictional stress. If there is only corrosive stress, the base layer (precoating) is sufficient.

DETAILED DESCRIPTION

Regarding the composition of the nickel bath according to the invention, the mode of action of nickel sulfate is clear and does not need to be explained. It can be used in a wide concentration range. High concentrations have more favorable effects than low concentrations.

The acid, in particular boric acid, has the object of stabilizing (buffering) the pH value. Since the current densities are low, the boric acid content can also be kept low. The low boric acid content makes it possible to allow the bath to cool to 20° C. during prolonged interruptions in operation, without crystallization having to be accepted.

The fluoride, in particular sodium fluoride, is intended to loosen the oxide layer, produced in the Licer bath, by partial solution. This leads to more rapid coverage. By contrast, an excessive concentration results in poor adhesion.

Chloride, in particular sodium chloride, promotes the dissolution of the nickel anodes, due to its chloride ions. Since the current density applied is relatively low, a high chloride content is not necessary, if the anode surface area is sufficiently large.

The phosphite, in particular sodium hypophosphite, makes a substantial contribution to the adhesive strength of the nickel layer. Diffusion of the electrolyte is also promoted. More extensive incorporation of phosphorus into the nickel layer should, however, be avoided, since otherwise the layer is passivated. This would cause adhesion problems in subsequent coatings. The sodium hypophosphite has a reducing action on the nickel.

In the bath equipment, fluoride-resistant CPVC of polypropylene is preferably used as the material of the trough. The heating elements are coated with polytetrafluoroethylene, since porcelain would be affected by fluorides. The filter installations, such as pump, filter and lines, are also fluoride-resistant. The anodes used are commercially available nickel anodes (plates). Titanium baskets are not sufficiently resistant. The anode surface area should be kept as large as possible.

The following values apply to a preferred bath: 200 g/l of nickel sulfate, 30 g/l of boric acid, 3 g/l of sodium fluoride, 2 g/l of sodium chloride and 1.5 g/l of sodium hypophosphite at a pH value of 4.8, a temperature of 55° C., a voltage of 2 volt and a current density of 0.5 ampere/dm$^2$.

Good results are likewise obtained when the concentration range of nickel sulfate is between 150 g/l and 300 g/l, the concentration range of boric acid is between 25 g/l and 40 g/l, the concentration range of sodium fluoride is between 2 g/l and 6 g/l, the concentration range of sodium chloride is between 1 g/l and 4 g/l and the concentration range of sodium hyperphosphite (sic) is between 1 g/l and 2 g/l.

Fluctuations in the working conditions are between 4.5 and 5.2 for the pH value, between 50° C. and 70° C. for the temperature, between 1.5 V and 4 V for the voltage and between 0.3 A/dm$^2$ and 1 A/dm$^2$ for the current density.

The process sequence is substantially the same as described in German Offenlegungsschrift No. 2,920,632: initially, degreasing by boiling is carried out. This is followed by pickling, using 10% caustic soda and pickling agents. Then the material is rinsed in water. Subsequently pickling in nitric acid with added fluoride is carried out, followed by a further rinse with water. Licering then follows, and another rinse in water. This is followed by the nickel bath according to the invention, and once more by rinsing in water. From this point, it is possible, if desired, to carry out further coatings with other metals, without an intermediate treatment.

Relatively thick layers of about 20 micrometers, and even up to 40 micrometers, with adequate ductility can be deposited.

Solids, such as, for example, silicon carbide or boron carbide, can be incorporated in the nickel layer.

The solids are kept in suspension in the bath by vigorous circulation, for example by means of air. The particle size should preferably be 3 micrometers.

The novel lead-free gasolines are initiating a development in which aluminum pistons must be coated with nickel also on the bottom. Due to the good layer distribution, the invention enables the nickel to be deposited both on the bottom and on the walls of the piston in the same process.

Entirely standard nickel electrodes can be used in the invention. Thus, they do not have to be specially prepared, as in other processes, for example enriched with carbon.

The current yield according to the invention is 90–95% instead of the usual 50%. After use, the bath can be cooled, left to stand for weeks, then heated up again to the correct temperature and re-used, without having to be analysed first for its usability. Even during operation, it is not necessary to analyse the bath continuously, for usability, as is otherwise customary.

In contrast to other nickel baths, the bath according to the invention does not flocculate, so that it does not need to be filtered all the time. Nevertheless, the surface of the nickel-plated goods is not rough.

The invention does not use ammonium chloride. The latter is a complex former. Only those chlorides are used which, on the other hand, promote the dissolution of the nickel electrodes but, on the other hand, do not represent complex formers.

I claim:

1. A method of electroplating heat-resistant articles selected from the group consisting of aluminum and aluminum alloy with a nickel layer, which articles have been given a Licer bath, comprising:

electroplating said articles with a nickel bath having concentrations of nickel sulfate within a range between 150 and 300 g/l, an acid within a range between 25 and 50 g/L, which stabilizes the pH values, a fluoride within a range between 2 and 6 g/L, which loosens the oxide layer forming in the Licer bath, a chloride within a range between 1 and 4 g/L, promoting dissolution of nickel anodes, whereby complex chloride formation is negligible, and a phosphite within a range between 1 and 2 g/L, improving the adhesive strength of the nickel layer.

2. A method according to claim 1, comprising contacting said articles with a nickel bath with a concentration of nickel sulfate of 200 g/l, a concentration of boric acid of 30 g/l, a concentration of sodium fluoride of 3 g/l, a concentration of sodium chloride of 2 g/l, and a concentration of sodium hypophosphite at 1.5 g/l.

3. A method according to claim 1, comprising operating the nickel bath in a temperature range of about 50° C. to 70° C.

4. A method according to claim 3, comprising operating the nickel bath at a temperature of 55° C.

5. A method according to claim 1 or 3 comprising operating the nickel bath at a voltage in the range of about 0.5 V to 4 V.

6. A method according to claim 5 comprising operating the nickel bath at a voltage of 2 V.

7. A method according to claim 1 or 3 comprising operating the nickel bath at a current density in the range of about 0.3 A/dm$^2$–1 A/dm$^2$.

8. A method according to claim 7 comprising operating the nickel bath at a current density of about 0.5 A/dm$^2$.

9. A method according to claim 7 comprising operating the nickel bath at a voltage in the range of about 0.5 V–4 V.

* * * * *